US007024883B2

(12) United States Patent
Sienel et al.

(10) Patent No.: US 7,024,883 B2
(45) Date of Patent: Apr. 11, 2006

(54) VAPOR COMPRESSION SYSTEMS USING AN ACCUMULATOR TO PREVENT OVER-PRESSURIZATION

(75) Inventors: Tobias H. Sienel, East Hampton, MA (US); Yu Chen, East Hasrtford, CT (US)

(73) Assignee: Carrier Corporation, Syracuse, NY (US)

( * ) Notice: Subject to any disclaimer, the term of this patent is extended or adjusted under 35 U.S.C. 154(b) by 21 days.

(21) Appl. No.: 10/742,037

(22) Filed: Dec. 19, 2003

(65) Prior Publication Data

US 2005/0132742 A1 Jun. 23, 2005

(51) Int. Cl.
*F25B 43/00* (2006.01)

(52) U.S. Cl. ..... 62/503; 62/512; 29/890.06

(58) Field of Classification Search ..... 62/83, 62/174, 470, 503, 509, 512; 29/890.06; 55/441, 55/449 R See application file for complete search history.

(56) References Cited

U.S. PATENT DOCUMENTS 5,167,128 A * 12/1992 Bottum ..... 62/174
5,282,370 A * 2/1994 Kiblawi et al. ..... 62/503
5,355,695 A * 10/1994 Kawaguchi et al. ..... 62/498
5,419,157 A * 5/1995 Kiblawi et al. ..... 62/503
5,471,854 A * 12/1995 DeNolf ..... 62/474
5,906,112 A * 5/1999 Amin et al. ..... 62/503
6,092,284 A * 7/2000 Dreiman et al. ..... 29/890.02
6,125,651 A * 10/2000 Tack et al. ..... 62/503
6,311,514 B1 * 11/2001 Chisnell ..... 62/503

FOREIGN PATENT DOCUMENTS

EP 1240936 A1 * 9/2002
JP 2000-304373 A * 11/2000

* cited by examiner

*Primary Examiner*—Mohammad M. Ali
(74) *Attorney, Agent, or Firm*—Carlson, Gaskey & Olds

(57) ABSTRACT

An accumulator acts as a buffer to prevent over-pressurization of the vapor compression system while inactive. By determining the maximum storage temperature and the maximum storage pressure a system will be subject to when inactive, a density of the refrigerant for the overall system can be calculated. Dividing the density by the mass of the refrigerant determines an optimal overall system volume. The volume of the components is subtracted from the overall system volume to calculate the optimal accumulator volume. The optimal accumulator volume is used to size the accumulator so that the accumulator has enough volume to prevent over-pressurization of the system when inactive.

13 Claims, 2 Drawing Sheets x=quality =mass fraction of vapor

| at 50F, | x | density (lbm/ft3) |
|---|---|---|
| | 0.2 | 25.9 |
| | 0.5 | 14.6 |
| | 0.8 | 10.1 |

VAPOR COMPRESSION SYSTEMS USING AN ACCUMULATOR TO PREVENT OVER-PRESSURIZATION

BACKGROUND OF THE INVENTION

The present invention relates generally to a vapor compression system including an accumulator sized to protect the system against over-pressurization when inactive.

Chlorine containing refrigerants have been phased out in most of the world due to their ozone destroying potential. "Natural" refrigerants, such as carbon dioxide and propane, have been proposed as replacement fluids. Carbon dioxide has a low critical point, which causes most air conditioning systems utilizing carbon dioxide as a refrigerant to run transcritically, or partially above the critical point, under most conditions, including when inactive. Under transcritical operations, pressure within the system becomes a function of both temperature and density.

A vapor compression system usually operates under a wide range of operating conditions. External atmosphere conditions, including temperature, can affect the pressure of the system while inactive. The system components (compressor, condenser/gas cooler, expansion device, evaporator and refrigerant lines) are designed to withstand a maximum pressure, but exposure to higher pressures may result in damage to the components. For most systems, the pressure in the system when not operational is a direct function of the temperature that the system is exposed to. However, when this temperature is near or above the critical point of the refrigerant, an additional factor must be considered. For supercritical fluids, the pressure in the system is a function of both the temperature and density of the fluid. This is not typically a concern for most refrigerants because their critical points are near or above normal storage temperatures. For carbon dioxide ($CO_2$) systems, however, this becomes an issue because the critical point is very low (88° F.).

A relief valve is typically incorporated into the system to protect the system and the components against over-pressurization. If pressure in the system approaches an over-pressurization point, the relief valve automatically opens to discharge refrigerant from the system and decrease the pressure to a safe range to protect the components from damage.

Vapor compression systems are typically designed to be stored at a certain maximum temperature, and the system components are designed to be able to withstand the maximum pressures associated with this temperature. The higher the storage temperature, the higher the design pressure usually needs to be. When the storage temperature is near or above the critical temperature of the refrigerant, the bulk density of the refrigerant is important in determining the system pressure, and therefore the design pressure. This is shown schematically in FIG. 1, which illustrates how the system pressure changes above the critical point for carbon dioxide as a function of both temperature and bulk density.

Prior vapor compression systems include an accumulator positioned between the evaporator and compressor that stores excess refrigerant. The accumulator is only sized to provide enough capacity for storing excess refrigerant during operation to prevent the excess refrigerant from entering the compressor. The accumulator can also be used to control the high pressure, and therefore the coefficient of performance, of the system during transcritical operation. However, the accumulator is not sized to determine a maximum pressure when the system is inactive or in storage.

Hence, there is a need in the art for a vapor compression system that includes an accumulator sized to prevent over-pressurization of the system while inactive, and a method for sizing such accumulator.

SUMMARY OF THE INVENTION

The present invention provides a vapor compression system including an accumulator which acts as a buffer to prevent over-pressurization of the system while inactive.

When a fluid is near or above its critical point, pressure is a function of both the temperature and the density. By knowing the maximum storage temperature and the maximum storage pressure, a density of the refrigerant for the overall system can be calculated and used to determine the ideal volume for the system.

The bulk density in the system is the system volume divided by the mass of the refrigerant in the system. Therefore, by dividing the mass of the refrigerant by the maximum desired storage density, an overall desired system volume can be determined. The total volume of the system without the accumulator can be subtracted from the overall desired system volume to calculate the optimal accumulator volume. The optimal accumulator volume is used to size the accumulator such that the accumulator can prevent over-pressurization of systems when stored at a storage temperature near or above the critical temperature of the refrigerant in the system.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompanies the detailed description can be briefly described as follows.

DETAILED DESCRIPTION OF THE PREFERRED EMBODIMENT

Figure 2:
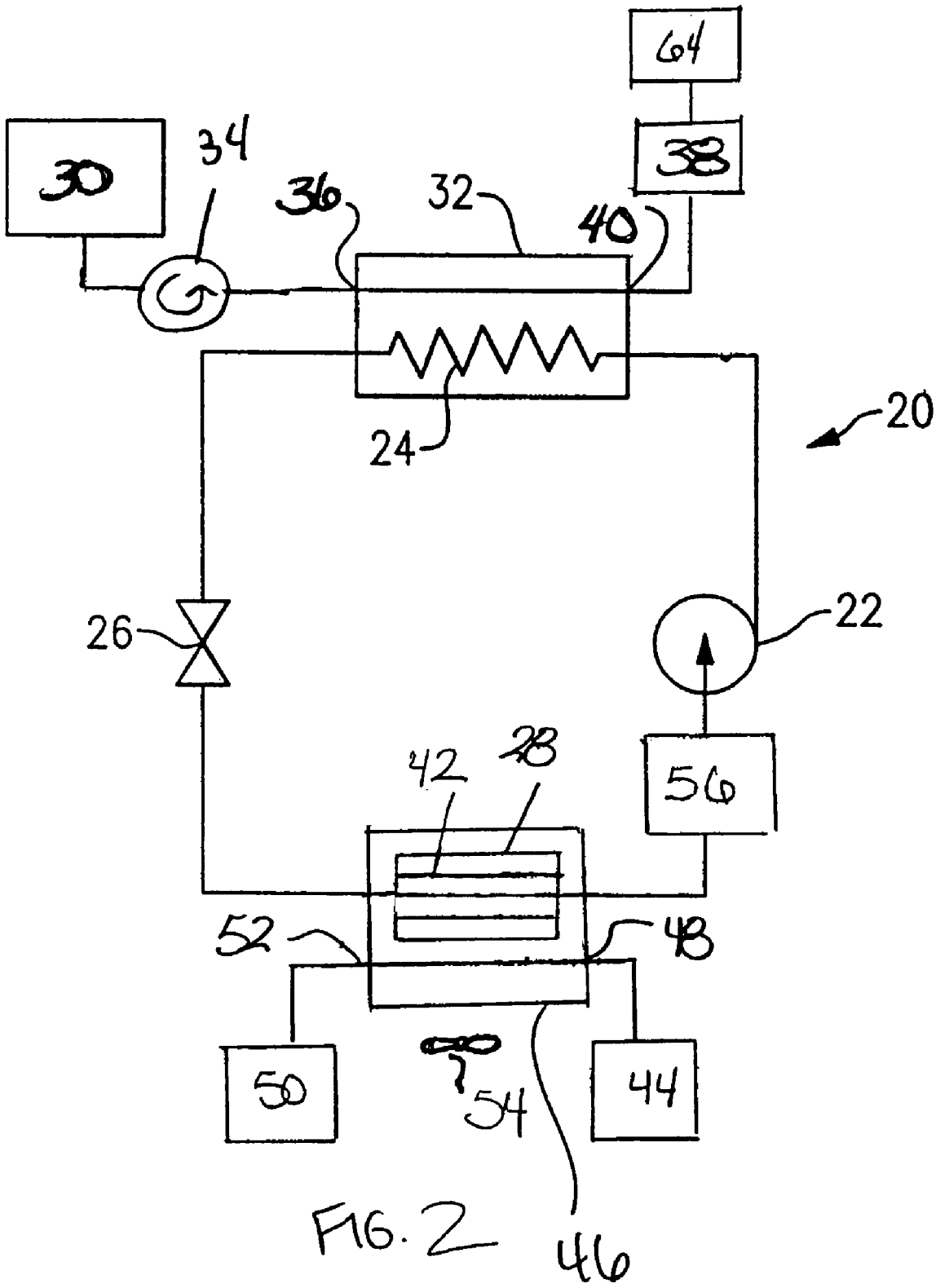
FIG. 2 schematically illustrates a diagram of the vapor compression system of the present invention, using an accumulator.

FIG. 2 illustrates an example vapor compression system 20 including a compressor 22, a heat rejecting heat exchanger (a gas cooler in transcritical cycles) 24, an expansion device 26, and a heat accepting heat exchanger (an evaporator) 28. Refrigerant circulates through the closed circuit system 20 through refrigerant lines.

In one example, carbon dioxide is used as the refrigerant. Because carbon dioxide has a low critical point, systems utilizing carbon dioxide as a refrigerant usually run transcritically. Although carbon dioxide is described, other refrigerants may be used.

The refrigerant exits the compressor 22 at a high pressure and a high enthalpy. The refrigerant then flows through the heat rejecting heat exchanger 24 at a high pressure. A fluid medium 30, such as water or air, flows through a heat sink 32 of the heat rejecting heat exchanger 24 and exchanges heat with the refrigerant flowing through the heat rejecting heat exchanger 24. In the heat rejecting heat exchanger 24, the refrigerant rejects heat into the fluid medium 30, and the refrigerant exits the heat rejecting heat exchanger 24 at a low enthalpy and a high pressure. Heat rejection can occur in the supercritical region because the critical temperature of carbon dioxide is 87.8° F., and the heat rejection fluid temperature is often higher than this temperature. When the vapor compression system 20 operates transcritically, the refrigerant in the high pressure section of the system is in the supercritical region where pressure is a function of both temperature and density.

A pump or fan 34 pumps a heat source fluid 44 through the heat sink 32. The cooled fluid medium 30 enters the heat sink 32 at the heat sink inlet or return 36 and flows in a direction opposite to the direction of the flow of the refrigerant. After exchanging heat with the refrigerant, the heated fluid 38 exits the heat sink 32 at the heat sink outlet or supply 40.

The refrigerant then passes through the expansion device 26, typically a valve which expands and reduces the pressure of the refrigerant. After expansion, the refrigerant flows through the passages 42 of the heat accepting heat exchanger 28 and exits at a high enthalpy and a low pressure. In the heat accepting heat exchanger 28, the refrigerant absorbs heat from the heat source fluid 44, heating the refrigerant. The heat source fluid 44 flows through a heat sink 46 and exchanges heat with the refrigerant passing through the heat accepting heat exchanger 28 in a known manner. The heat source fluid 44 enters the heat sink 46 through the heat sink inlet or return 48. After exchanging heat with the refrigerant, the cooled heat source fluid 50 exits the heat sink 46 through the heat sink outlet or supply 52. The temperature difference between the heat source fluid 44 and the refrigerant in the heat accepting heat exchanger 28 drives the thermal energy transfer from the heat source fluid 44 to the refrigerant as the refrigerant flows through the heat accepting heat exchanger 28. A fan or pump 54 moves the heat source fluid 44 across the heat accepting heat exchanger 28, maintaining the temperature difference and evaporating the refrigerant. The refrigerant then renters the compressor 22, completing the cycle. The system 20 transfers heat from the low temperature energy reservoir to the high temperature energy sink.

The system 20 further includes an accumulator 56 located between the heat accepting heat exchanger 28 and the compressor 22. The accumulator 56 can store excess refrigerant in the system 20 and also to control the high pressure of the system 20, and therefore the coefficient of performance of the system 20 when operated transcritically. During operation of the system 20, the accumulator 56 prevents excess refrigerant from entering the compressor 22.

When a vapor compression system 20 is stored or transported in hot climates, such as deserts, the refrigerant temperature increases due to the high temperature of the surroundings. The increased temperature increases the pressure within the system 20 and can cause over-pressurization, leading to the activation of a pressure relief valve or bursting of a refrigerant line or system 20 component.

Bulk density is defined as the mass of the refrigerant in the system divided by the system volume. Since both the temperature and density of the refrigerant can affect the system pressure when the system is stored at or above the critical point of the refrigerant, the system volume of a vapor compression system 20 also affects the pressure within the system when the system is stored at or above the critical point of the refrigerant. As the system volume increases at a given temperature at or above the critical point of the refrigerant, the system pressure decreases.

Figure 1:
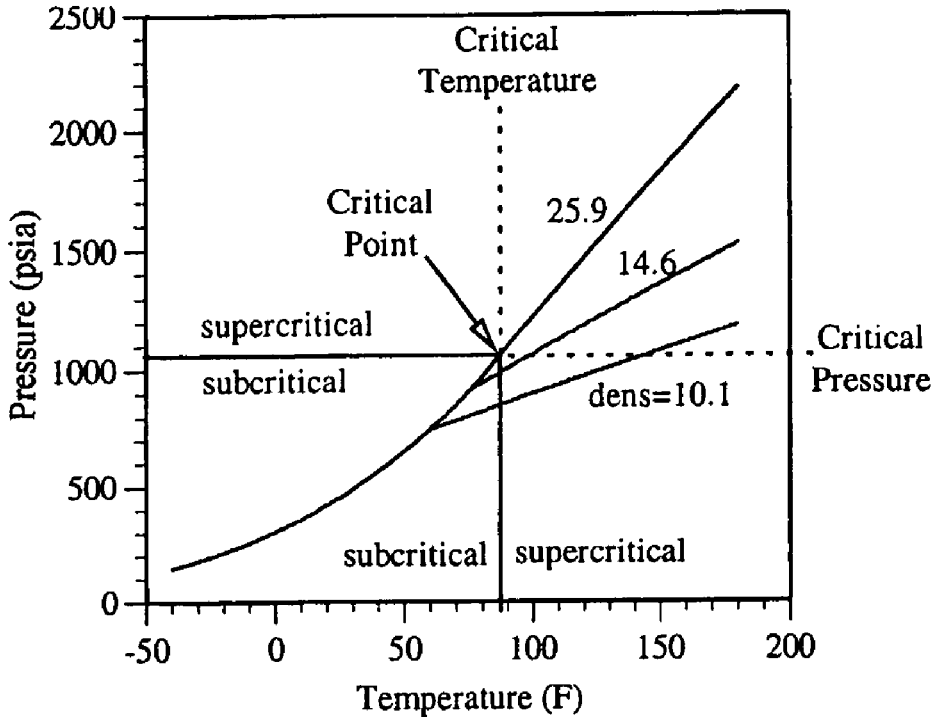
FIG. 1 schematically illustrates a graph demonstrating how the pressure of carbon dioxide changes above the critical point as a function of both temperature and bulk density.

When the system 20 is inactive, the accumulator 56 may act as a buffer to reduce the increase in excess pressure and prevent over-pressurization of the system 20. The size of the accumulator 56 affects the overall volume of the system 20, and thus the maximum storage pressure of the system 20. By increasing the volume of the accumulator 56, the bulk density of the refrigerant in the system 20 decreases, and thus the pressure of the refrigerant within the system 20 decreases. By decreasing the volume of the accumulator 56, the pressure of the refrigerant within the system 20 increases. FIG. 1 shots this effect for a system using carbon dioxide as the refrigerant. In the present invention, the preferred size of the accumulator 56 is calculated to prevent over-pressurization of the system 20 when inactive or when transported. That is, the accumulator 56 is sized to be large enough to prevent over-pressurization, but not too large to be overly expensive.

The volume of the accumulator 56 is determined based on the maximum design storage temperature and the maximum storage pressure of the refrigerant. As the storage temperature increases, the temperature of the refrigerant within the system 20 increases. Increasing the refrigerant temperature increases the refrigerant pressure within the system 20. Decreasing the refrigerant temperature decreases the refrigerant pressure within the system 20. The maximum storage temperature of the refrigerant in the system 20 depends of the climate. In hot climates, the maximum storage temperature increases due to the increase in the atmospheric temperature. In cooler climates, the maximum storage temperature is lower due to the decrease in the atmospheric temperature. For system manufactured to global requirements, the highest storage temperature will typically be chosen.

For system 20 with refrigerants having a relatively high critical temperature that is not near the maximum storage temperature of the system, the maximum storage temperature alone determines the maximum storage pressure through the refrigerant saturation properties. This can be seen in FIG. 1 for temperatures less than approximately 60° F. For systems 20 which use refrigerants having a relatively low critical temperature (such as carbon dioxide) both the maximum storage temperature and the system bulk density determines the maximum storage pressure of the system 20. This can be seen in FIG. 1 for temperatures greater than approximately 60° F. That is, by knowing the maximum storage temperature the refrigerant will reach when inactive, and the maximum design storage pressure, the optimal bulk density can be calculated and used to size the accumulator in the system.

The maximum design storage pressure of the system is generally limited by the low pressure side of the system. During operation, the low pressure side of the system will generally be exposed to pressures lower than when inactive or stored than when operating. For refrigerants having a relatively high critical point, the selection of the maximum design pressure is generally made with reference only to the maximum design temperature. For refrigerant having a relatively low critical point, additional considerations, such as the manufacturing cost needed for thicker walled components, need to be taken into consideration. Generally, the maximum storage pressure for a system using carbon dioxide as the refrigerant is between 1000 and 2500 psi.

Density, when outside the saturated region, is a function of temperature and pressure. Thus, if the maximum storage temperature and the maximum storage pressure are known, the maximum storage bulk density can be determined.

Volume can be calculated by dividing density with mass. Dividing the maximum storage density by the mass of the refrigerant determines an optimal overall system volume. The calculation below can be used to obtain the ideal overall system volume:

$$V_{System} = \frac{Mass_{Refrigerant}}{Density_{Refrigerant}}$$

The components in the system 20, except the accumulator 56, have a known component volume. These components include the compressor 22, the heat rejecting heat exchanger 24, the expansion device 26, the heat accepting heat exchanger 28, and the refrigerant lines connecting the components. The accumulator 56 is the only component in the system 20 having an unknown volume. By subtracting the total component volume from the overall system volume, the optimal accumulator volume can be determined. It is to be understood that the total component volume includes the total volume of all the components in the system 20, except for the accumulator 56. Using the above equation, the optimal accumulator volume can be calculated:

$$V_{AccumulatorOptimal} = \frac{Mass_{Refrigerant}}{Density_{Refrigerant}} - V_{components}$$

The above equation determines the optimal volume of the accumulator based on the maximum storage pressure of the refrigerant, the maximum storage temperature of the refrigerant, the refrigerant mass, and the volume of the system components. Preferably, the accumulator 56 volume is selected within 80 to 120 percent of the calculated optimal size, resulting in a desired accumulator 56 size that protects the system 20 against over-pressurization while inactive or during transport.

It should be understood that the example described for the single stage system using carbon dioxide is only an example. The optimal accumulator size can also be determined for multiple compression stage systems, systems which use internal heat exchangers, and systems with other additional system components, such as oil separators and filter dryers. The optimal accumulator size can also be determined for systems with multiple heat rejecting heat exchangers 24, expansion devices 26, and heat accepting heat exchanger 28. In addition, the accumulator in this example has been described to be located between the evaporator and the compressor. However, it is to be understood that the accumulator can also be at another location. This invention also applies equally to systems which use charge storage components located in other parts of the system, such as at the inlet of the evaporator or between the condenser (or gas cooler) and the evaporator. Additionally, the accumulator can also be divided into two or more charge storage components located in different parts of the system, in which case the optimal accumulator size applies to the sum of the volumes of each of the charge storage components.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A vapor compression system comprising:

at least one compression device to compress a refrigerant to a high pressure;

at least one heat rejecting heat exchanger for cooling said refrigerant;

at least one expansion device for reducing said refrigerant to a low pressure;

at least one heat accepting heat exchanger for evaporating said refrigerant; and an accumulator having an optimal size, wherein said optimal size of said accumulator prevents over-pressurization of the system when said refrigerant is at a maximum refrigerant temperature and a maximum refrigerant pressure, wherein said maximum refrigerant temperature is the maximum temperature the refrigerant reaches when the system is inactive and the maximum refrigerant pressure is the maximum pressure the refrigerant reaches when the system is inactive.

2. The vapor compression system as recited in claim 1, wherein a desired system volume is determined using said maximum refrigerant temperature and said maximum refrigerant pressure, and wherein said optimal size of said accumulator is equal to a difference between said desired system volume and a total component volume of components in the system before addition of said accumulator.

3. The vapor compression system as recited in claim 1, wherein said refrigerant is carbon dioxide.

4. The vapor compression system as recited in claim 1, wherein a size of said accumulator is between 80 percent to 120 percent of said optimal size.

5. The vapor compression system as recited in claim 6 wherein said maximum storage pressure is between 1000 and 2500 psi.

6. The vapor compression system as recited in claim 1, wherein said optimal size of said accumulator is determined by utilizing a maximum storage temperature, a maximum storage pressure, a mass of said refrigerant, and a total component volume of the system.

7. The vapor compression system as recited in claim 6, wherein the total component volume of the system includes a total compressor volume of the at least one compressor, a total heat rejecting heat exchanger volume of the at least one heat rejecting heat exchanger, a total expansion device volume of the at least one expansion device, a total heat accepting heat exchanger volume of the at least one heat accepting heat exchanger, and a total refrigerant line volume of refrigerant lines.

8. The vapor compression system as recited in claim 7, further including at least one of an internal heat exchanger, an oil separator and a filter dryer, and wherein the total component volume further includes a total internal heat exchanger volume of said internal heat exchanger, at least one oil separator volume of said oil separator, and a total filter dryer volume of said filter dryer.

9. The vapor compression system as recited in claim 8 wherein the component volume further includes a total additional component volume of any additional components.

10. The vapor compression system as recited in claim 2 wherein the optimal accumulator volume is a sum of all charge storage components in the system.

11. The vapor compression system as recited in claim 6 wherein the maximum storage temperature is between −50 and 200 degrees F.

12. The vapor compression system as recited in claim 5 wherein the maximum storage temperature is between −50 and 200 degrees F.

13. The vapor compression system as recited in claim 1, wherein said system does not include a valve to relieve pressure in the system.

* * * * *